US010217334B2

(12) United States Patent
Yang et al.

(10) Patent No.: US 10,217,334 B2
(45) Date of Patent: Feb. 26, 2019

(54) REFUGE GUIDE SYSTEM AND METHOD

(71) Applicant: NEXCOM International Co., Ltd., New Taipei (TW)

(72) Inventors: Chung-Shu Yang, New Taipei (TW); Alexander I-Chi Lai, New Taipei (TW)

(73) Assignee: NEXCOM INTERNATIONAL CO., LTD., New Taipei (TW)

( * ) Notice: Subject to any disclaimer, the term of this patent is extended or adjusted under 35 U.S.C. 154(b) by 87 days.

(21) Appl. No.: 15/609,011

(22) Filed: May 31, 2017

(65) Prior Publication Data

US 2018/0350207 A1 Dec. 6, 2018

(51) Int. Cl.

| | |
|---|---|
| ***G08B 3/10*** | (2006.01) |
| ***G08B 7/06*** | (2006.01) |
| ***A62C 27/00*** | (2006.01) |
| ***A62C 37/40*** | (2006.01) |

(52) U.S. Cl.

CPC ..... *G08B 7/066* (2013.01); *A62C 27/00* (2013.01); *A62C 37/40* (2013.01); *G08B 3/10* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,810,415 | B2 | 8/2014 | Grundler et al. | |
| 2008/0001735 | A1* | 1/2008 | Tran | G06F 19/3418 340/539.22 |
| 2010/0245083 | A1 | 9/2010 | Lewis | |
| 2015/0338849 | A1* | 11/2015 | Nemec | G05D 1/0055 701/25 |
| 2017/0124842 | A1* | 5/2017 | Sinha | G05B 19/048 |

FOREIGN PATENT DOCUMENTS

| | | | |
|---|---|---|---|
| CN | 102309826 | A | 1/2012 |
| CN | 103157199 | A | 6/2013 |
| CN | 103394171 | A | 11/2013 |
| CN | 104548415 | A | 4/2015 |
| DE | 102015220044 | A1 | 4/2017 |
| TW | M484769 | | 8/2014 |
| TW | 201618045 | A | 5/2016 |
| WO | 2016/180796 | A1 | 11/2016 |

OTHER PUBLICATIONS

Office Action dated Jul. 28, 2017 of the corresponding Taiwan patent application No. 106110547.
Search Report dated Nov. 24, 2017 of the corresponding European patent application No. EP17173245.6.

* cited by examiner

*Primary Examiner* — Thomas S McCormack
(74) *Attorney, Agent, or Firm* — Chun-Ming Shih; HDLS IPR Services

(57) ABSTRACT

A refuge guide system including a central server (10), a refuge guide device (100), a plurality of fire monitoring devices (30), and a wireless communication device (40). The plurality of fire monitoring devices (30) transmit a fire information to the central server (10). The wireless communication device (40) provides communication between the central server (10) and the refuge guide device (100), and provides a positioning information to the refuge guide device (100).

13 Claims, 7 Drawing Sheets

REFUGE GUIDE SYSTEM AND METHOD

BACKGROUND OF THE INVENTION

Field of the Invention

The present invention relates to a guide system and method, especially to a guide system and method for refuge and fire hazard evacuation.

Description of Prior Art

In metropolitan area, there are more and more large buildings, exhibition halls and stores, which typically have many escape exits. However, the layout of escape exits is more complicated for large buildings. When disaster happens, people begin aimlessly looking for escape exits or escaping following the crowd. Such phenomenon may cause too many people using the same exits and pushing each other, and cause more casualties. When the alarm rings, people are told that there is a disaster without receiving more detailed information (disaster locations, types of disasters, escape direction . . . ), so that people cannot escape immediately or people will choose the wrong path and thus put themselves in a more dangerous situation.

The existing fire escape guidance voice indicator uses loudspeaker to broadcast pre-recorded content when fire happens, where the pre-recorded content is stored in the voice chip and based on various terrains of building and evacuation routes. However, this escape guidance voice indicator lacks the capability of knowing the right place or the capability of changing the predetermined evacuation route according to the disaster situation, and thus may result in incorrect escape and evacuation guide. Besides, the aforementioned indicator lacks important functions of evacuation for people acting with poor physical agility.

Thus, it needs better refuge guide system and method provided to solve the issue mentioned above.

SUMMARY OF THE INVENTION

Accordingly, the present invention provides a refuge guide system and method. The refuge guide system includes: a central server, including: a calculation unit; a memory device electrically connected to the calculation unit, and storing a map data and a user setting data; and a central communication unit electrically connected to the memory device and the calculation unit, the central communication unit transmitting a guide information; a refuge guide device including: a control unit including a memory element; a wired communication unit electrically connected to the control unit; a wireless communication unit electrically connected to the control unit; and a transport unit electrically connected to the control unit; a plurality of fire monitoring devices arranged for transmitting a fire information to the central server; and a wireless communication device arranged for providing communication between the central server and the refuge guide device, and providing a positioning data of the refuge guide device.

The present invention is further objected to provide a refuge guide method arranged for a refuge guide device, the refuge guide method includes the following steps: transmitting a guide information to the refuge guide device by a central server; executing the guide information by the refuge guide device; and determining if a wireless communication device configured to provide communication with the central server by the refuge guide device.

BRIEF DESCRIPTION OF DRAWING

One or more embodiments of the present disclosure are illustrated by way of example and not limitation in the figures of the accompanying drawings, in which like references indicate similar elements. These drawings are not necessarily drawn to scale.

DETAILED DESCRIPTION OF THE INVENTION

Figure 1:
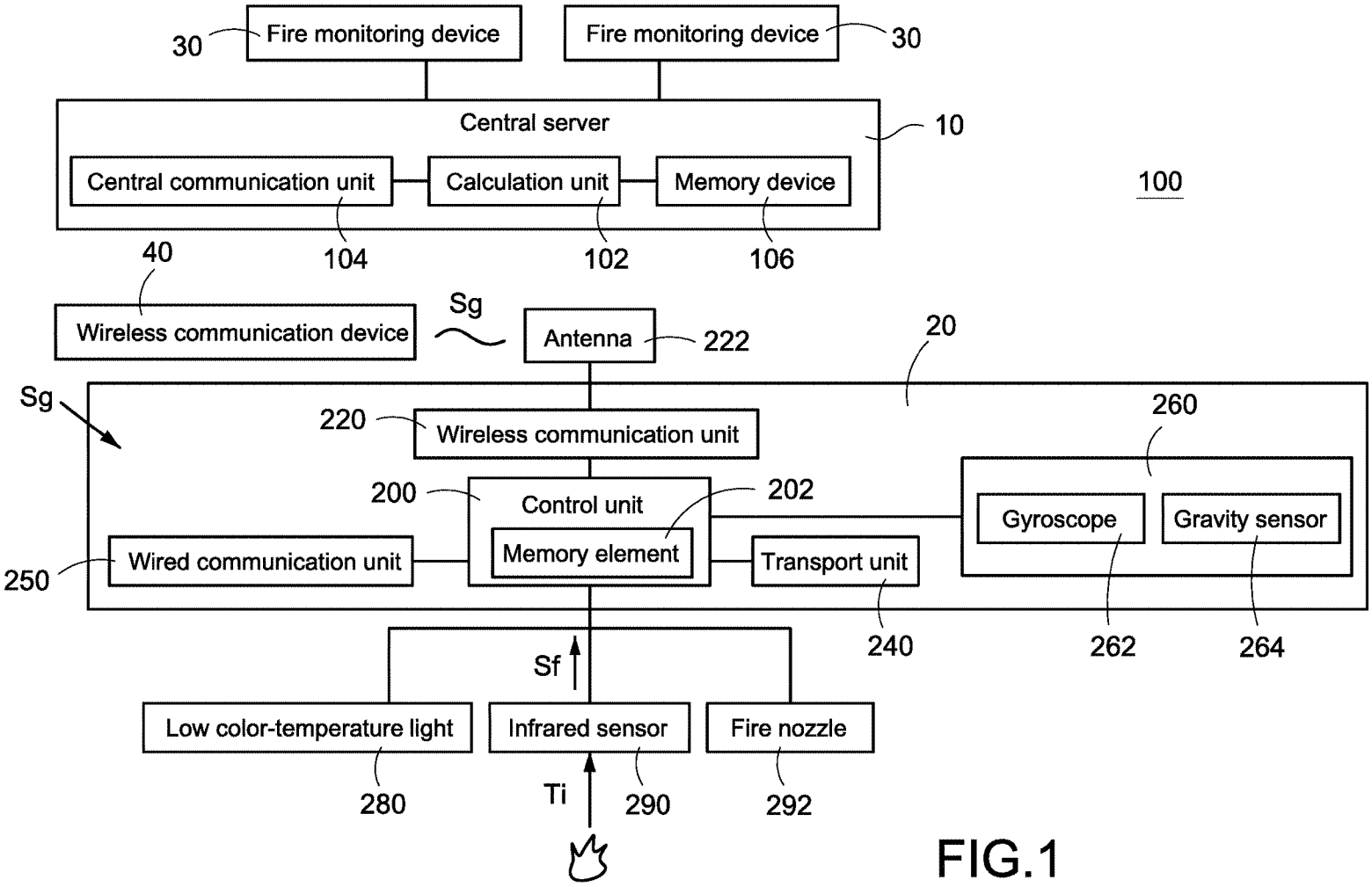
FIG. 1 shows a block diagram of a refuge guide system according to an embodiment of the present invention.
Figure 2B:
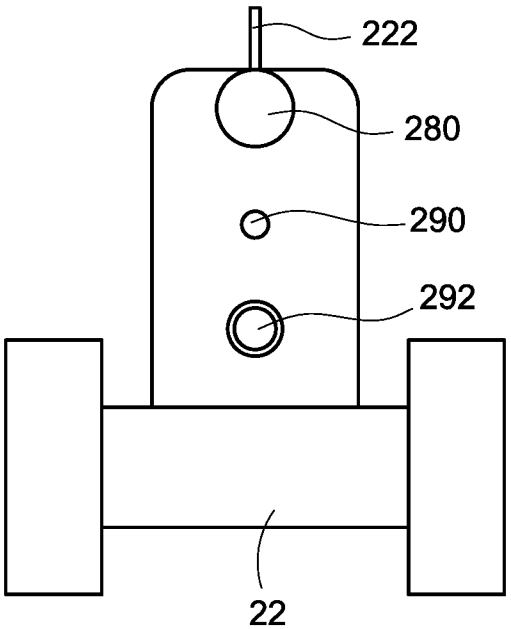
FIG. 2B shows a front view of the refuge guide device in FIG. 2A.
Figure 2A:
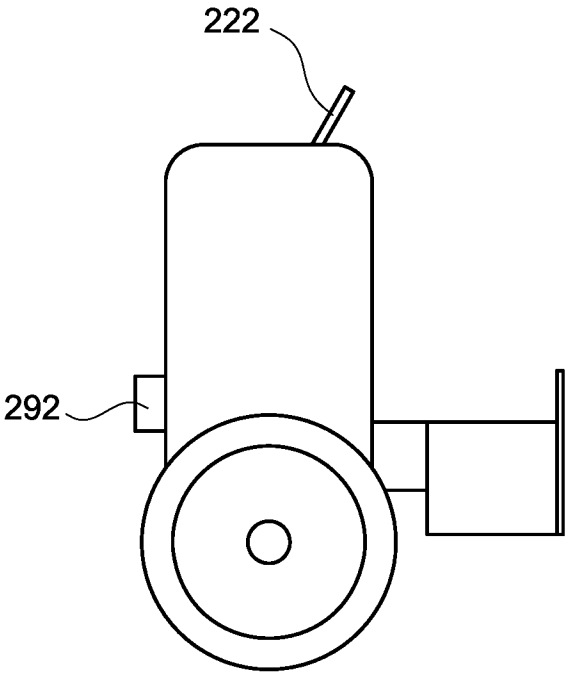
FIG. 2A shows a sectional view of a refuge guide device according to an embodiment of the present invention.

Please refer to FIG. 1-FIG. 2B, FIG. 1 shows a block diagram of a refuge guide system according to an embodiment of the present invention, FIG. 2A shows a sectional view of a refuge guide device 20 according to an embodiment of the present invention, FIG. 2B shows a front view of the refuge guide device 20 in FIG. 2A. The present invention provides a refuge guide system 100, the refuge guide system 100 includes a central server 10, a refuge guide device 20, a plurality of fire monitoring devices 30 and a wireless communication device 40. The central server 10 and the refuge guide device 20 may be wired or wirelessly connected to transmit information to each other (described in detail later). These fire monitoring devices 30 are preferably arranged at or near predetermined escape route for a place needing to provide refuge guide (for example, department store or hospital) and used for monitoring fire, and transmitting fire information to the central server 10 by wired or wireless communication. Therefore, the central server 10 may update fire condition and re-plan the escape route. The wireless communication device 40 is arranged at a predetermined position in the place needing to provide refuge guide and provides communication between the central server 10 and the refuge guide device 20, as well as provides a positioning data of the refuge guide device 20.

The central server 10 includes a calculation unit 102, a memory device 106 storing map data and user setting data relative to the place needing to provide refuge guide; and a central communication unit 104 performing wireless communication with the refuge guide device 20 through the wireless communication device 40, or performing wired communication with the refuge guide device 20 through power line network.

The refuge guide device 20 includes: a control unit 200, a wireless communication unit 220, a transport unit 240, a wired communication unit 250, and an auxiliary positioning unit 260. The control unit 200 is electrically connected to other units respectively. Refer to FIG. 1, the central server 10 periodically, or according to a certain condition (such as fire or other disasters), transmits a guide information Sg to the wireless communication unit 220 of the guide device 20 via the antenna, and the wireless communication unit 220 transmits the guide information Sg to the control unit 200 such that the guide information Sg may be stored in a memory element 202 of the control unit 200. The guide information Sg may also be transmitted to the wired communication unit 250 through wired communication (such as Home Plug protocol). The guide information Sg is an evacuation or escape plan for the environment needing to provide refuge guide when disaster (such as fire) happens. The auxiliary positioning unit 260 includes, for example, a gyroscope 262 for providing azimuth angle information to the refuge guide device 20, and a gravity sensor 264 for sensing a speed and acceleration of the refuge guide device 20. The auxiliary positioning unit 260 may provide the aforementioned auxiliary positioning information (including the azimuth angle information, speed and acceleration of the refuge guide device 20) to the control unit 200, for the control unit 200 calculating position/moving direction of the refuge guide device 20, and controlling the transport unit 240 to move along the escape route. Besides, when the wireless communication device 40 works normally, the auxiliary positioning unit 260 may also provide auxiliary positioning information. Therefore, the positioning of the refuge guide device 20 can be achieved by the wireless communication unit 220 and the auxiliary positioning unit 260.

Refer to FIG. 2A and 2B together, the refuge guide device 20 further includes a baseplate 22 for supporting units in the refuge guide device 20; a low color-temperature light 280 electrically connected to the control unit 200 and used as the auxiliary illumination for user; an infrared sensor 290 electrically connected to the control unit 200 and used for sensing a locale environment temperature Ti and generating a locale fire information Sf for the control unit 200; an antenna 222 electrically connected to the control unit 200 and used for receiving the guide information Sg for the wireless communication unit 220; and a fire nozzle 292 electrically connected to the control unit 200 and driven by the control unit 200 to perform fire extinguishing.

It needs to be known that FIGS. 2A, 2B are only description for example, if the refuge guide device 20 is used to perform fire escape for old people or handicapped people in hospital or rest home, then the refuge guide device 20 may be implemented with sick bed or wheel chair, and may further include equipment for user sitting or lying (not shown).

Figure 3A:
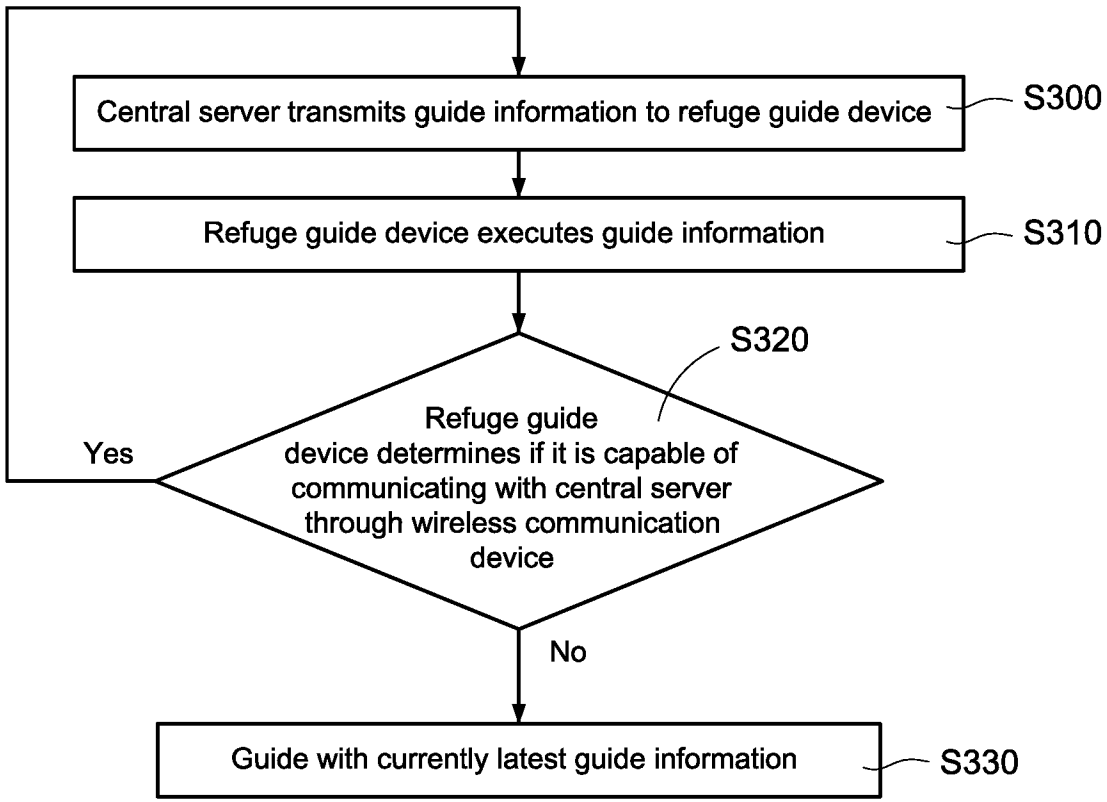
FIG. 3A shows a flowchart of an operation method of a refuge guide system according to an embodiment of the present invention.

The operation of the refuge guide system 100 is further described together with the flowchart of the present invention in the following, with reference to FIGS. 3A and 4A, and with reference to FIGS. 1, 2A, 2B. In step S300, the central server 10 transmits a guide information to the refuge guide device 20. The guide information includes data of the latest fire simulation and escape plan etc. Refer to FIG. 4A, the refuge guide device 20, for example, may be located at a predetermined position Pa of a place (such as department store) needing to provide refuge guide in advance, and electrically connected to a power line network plug of the department store, and perform charging through the power line network plug, and to receive the guide information transmitted by the central server 10 through the power line network. According to another implementation, the refuge guide device 20 receives the guide information transmitted by the central server 10, via the wireless communication network (such as Wi-Fi network) provided by the wireless communication device 40. Besides, the guide information may be transmitted at constant time interval (such as each week), immediately after an accident happening, or at a predetermined period of time after an accident happening. For example, the fire monitoring device 30 detects that the fire happens and obtains the fire information, and then transmits the fire information to the central server 10, the calculation unit 102 of the central server 10 calculates (according to a map data, the fire information, and positioning information of the refuge guide device 20 in the place needing to provide refuge guide) the latest guide information Sg, and transmits the guide information Sg to the refuge guide device 20. According to an implementation of the present invention, the calculation unit 102 of the central server 10 transmits the latest guide information Sg to refuge guide device 20, and transmits refuge enabling command to the refuge guide device 20 for the refuge guide device 20 to execute the guide information Sg immediately.

In step S310, the refuge guide device 20 executes guide information Sg, and guide user to move from a location Pa that the refuge guide device 20 is originally located to a refuge location Pb, along a route Ra planned according to the guide information, detailed description relative to step S310 will be described together with other drawings in the following.

In step S320, the refuge guide device 20 determines if it is capable of communicating with the central server 10 through the wireless communication device 40, that is, if the updated fire information can be received continuously. Because the refuge guide system 100 has the fire monitoring device 30 located at the predetermined location, fire along route planned according to the guide information can be monitored ideally, and the refuge guide system 100 immediately determines whether to change the guide information Sg. However, the fire condition changes unexpectedly, if the wireless communication device 40 malfunctions due to fire, then the refuge guide device 20 cannot communicate with the central server 10 through the wireless communication device 40, and cannot receive the updated fire information. In step S320, if the refuge guide device 20 determines that the communication with the central server 10 is still working through the wireless communication device 40, then step S300 is performed to continue to receive the guide information Sg. If the refuge guide device 20 determines that the communication with the central server 10 is not working through the wireless communication device 40, then step S330 is performed to guide with the currently latest guide information Sg.

Figure 3B:
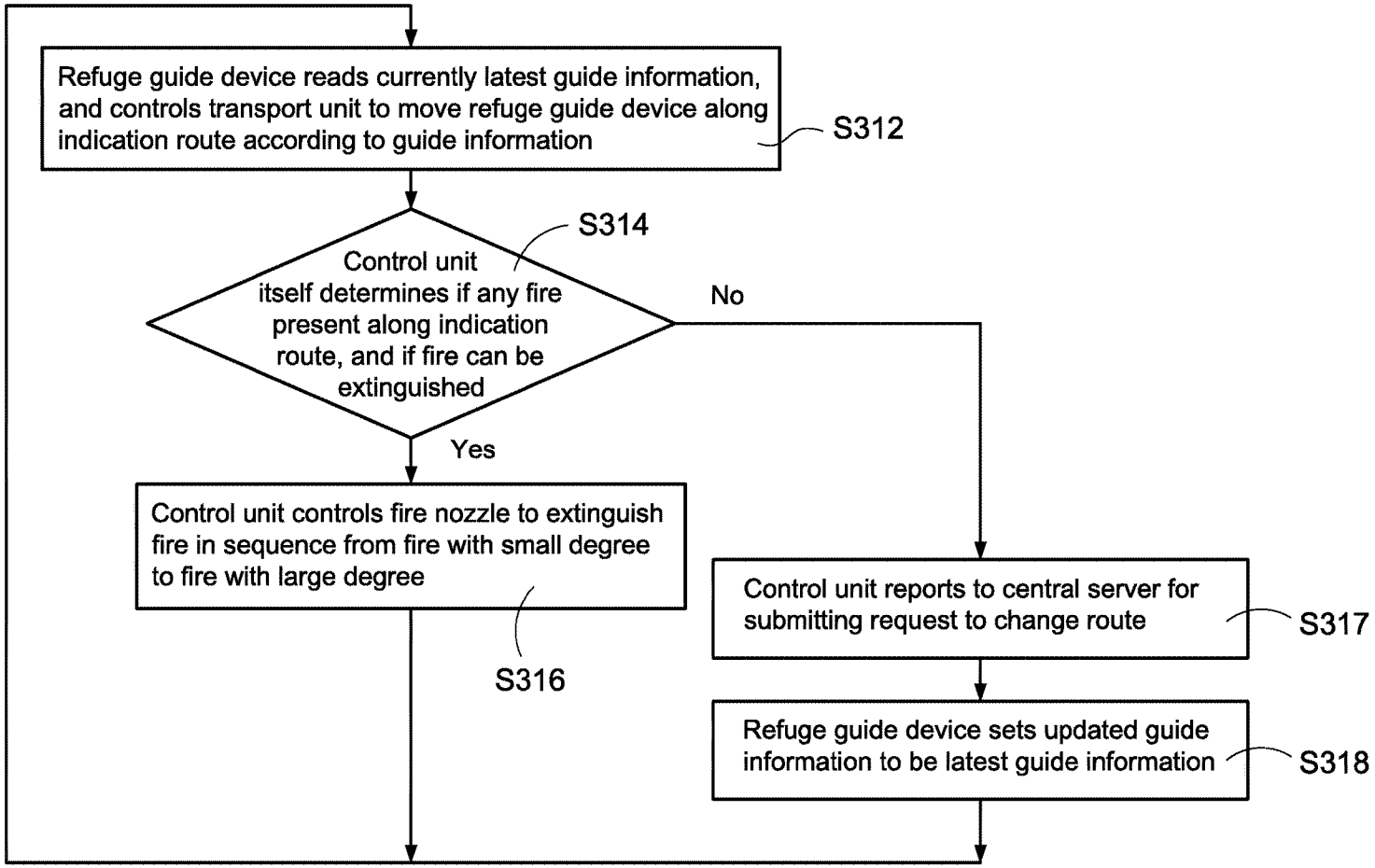
FIG. 3B shows a flowchart of a detail content of the operation method of the refuge guide system in FIG. 3A.

Refer to FIG. 3B, FIG. 3B shows detail of step S310 according to an implementation of the present invention. In step S312, the refuge guide device 20 reads the currently latest guide information Sg, and controls the transport unit 240 to move the refuge guide device 20 along an indication route according to the guide information Sg. For example, the transport unit 240, moving the refuge guide device 20 along a route Ra shown in FIG. 4A, guides user to escape from the position Pa to a safe position Pb. When the refuge guide device 20 moves along the indication route, the low color-temperature light 280 may provide illumination light to user for recognizing the surrounding environment. The infrared sensor 290 senses a locale environment temperature Ti (that is, temperature of environment surrounding the refuge guide device 20) while moving along the indication route, and generates a locale fire information Sf to the control unit 200. The control unit 200 may send the locale fire information Sf back to the central server 10, for further updating the fire condition and updating the guide information Sg if possible. In step S314, the control unit 200 itself determines (or the central server 10 makes determinations and then sends result to the control unit 200) if any fire present along the indication route, and if the fire can be extinguished. If the fire is determined to be extinguishable, then the control unit 200 controls the fire nozzle 292 to extinguish the fire in sequence from fire with small degree to fire with large degree, for removing obstacle along the indication route (step S316). If the fire is determined to be not extinguishable, the control unit 200 can report to the central server 10 for submitting request to change the route (step S317), or the central server 10 itself controls the refuge guide device 20 to change the route and transmits the updated guide information Sg to the refuge guide device 20. Then, in step S318, the refuge guide device 20 sets the updated guide information Sg (or changed route) to be the latest guide information Sg, and it returns to step S312 for continuing to perform route guide.

Figure 4B:
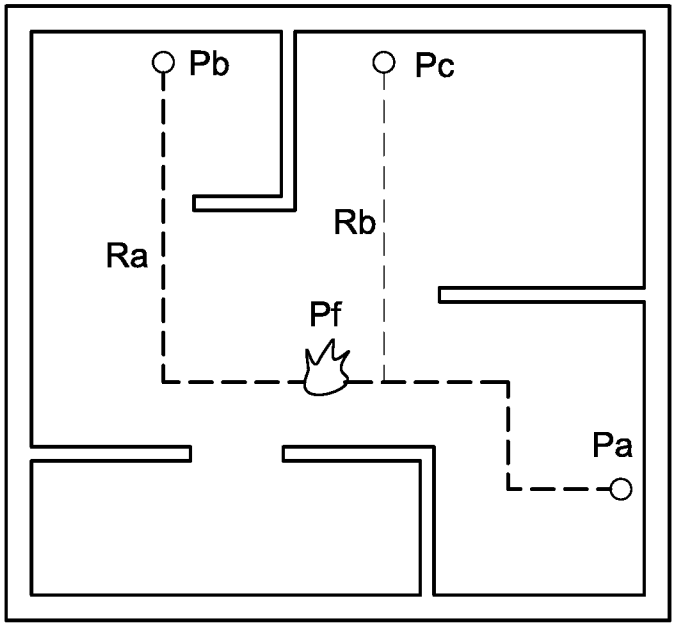
FIG. 4B shows a diagram of implementation of the operation methods of the refuge guide system in FIG. 3B and FIG. 3C.
Figure 4A:
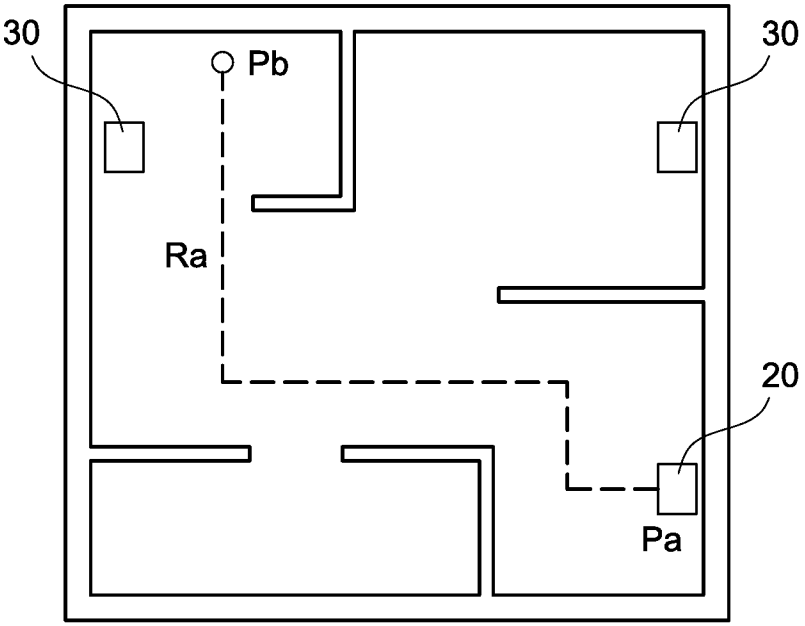
FIG. 4A shows a diagram of implementation of the operation method of the refuge guide system in FIG. 3A.

Refer to FIG. 4B, FIG. 4B describes the flowchart of determining of FIG. 3B. Assume that the refuge guide device 20 is located at the position Pa originally, after the fire happens, the refuge guide device 20 guides (according to guide information Sg) the user to move along the route Ra. If an infrared sensor 290 of the refuge guide device 20 senses the temperature Ti of environment surrounding a position Pf (which is ahead of the route to be passed) is too high, while moving along the indication route, and it is not possible to move forward, then the refuge guide device 20 itself determines (or according to the central server 10) to perform extinguishing, for moving along the original route Ra. Moreover, if the guide device 20 itself determines (or according to the central server 10) the fire is too large, and not extinguishable, then the route can be changed, and the new route Rb is followed to arrive another escape entrance Pc.

Figure 3C:
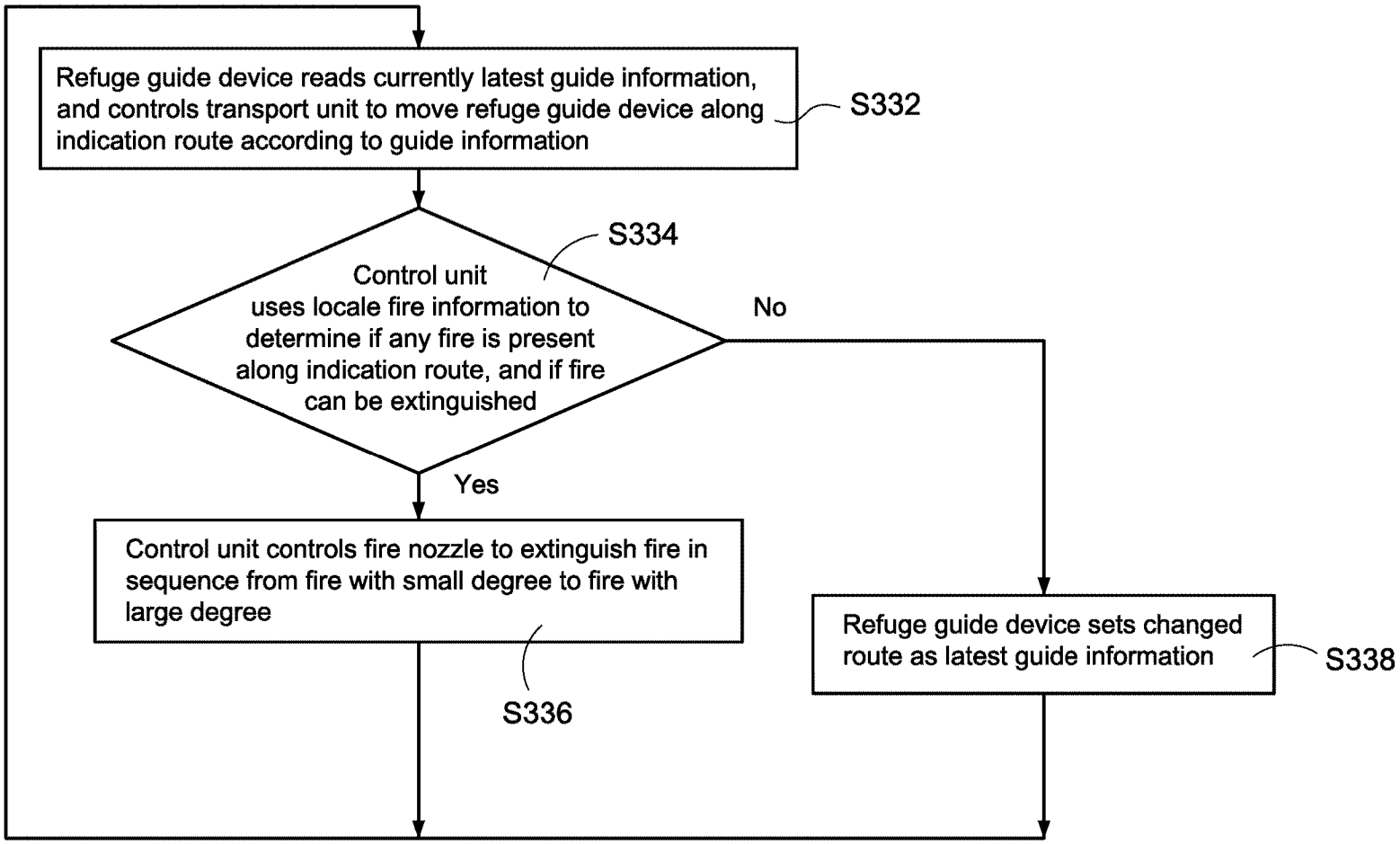
FIG. 3C shows a flowchart of another detail content of the operation method of the refuge guide system in FIG. 3A.

Refer to FIG. 3C, FIG. 3C describes detail of step S330 according to an implementation of the present invention. In step S332, the refuge guide device 20 reads the currently latest guide information Sg, and controls the transport unit 240 to move the refuge guide device 20 along the indication route according to the guide information Sg. For example, moving along the route Ra shown in FIG. 4A, for guiding user to escape from the position Pa to the safe position Pb. Because the wireless communication device 40 malfunctions or functions in unreliable way, the refuge guide device 20 uses a gyroscope 262 in the auxiliary positioning unit 260 to calculate an azimuth angle information of the refuge guide device 20, and uses a gravity sensor 264 to calculate a speed and acceleration of the refuge guide device 20, and the auxiliary positioning unit 260 integrates the azimuth angle/speed/acceleration of the refuge guide device 20 into an auxiliary positioning information, and provides the auxiliary positioning information to the control unit 200, for the control unit 200 calculating the position/moving direction of the refuge guide device 20, in this way, the positioning unit 260 together with the control unit 200 replaces the position function originally achieved by the wireless communication unit 220 and the wireless communication device 40, and used for executing the position function for the refuge guide device 20, and move along the indication route according to the guide information Sg. Similarly, the low color-temperature light 280 may provide illumination to user for recognizing the surrounding environment. The infrared sensor 290 senses the temperature Ti of the locale environment (that is, temperature of the environment surrounding the refuge guide device 20) while moving along the indication route, and generates a locale fire information Sf to the control unit 200. The control unit 200 uses the locale fire information Sf to determine if any fire is present along the indication route, and if the fire can be extinguished (step S334). If it is determined that the fire may be extinguished, then the control unit 200 controls the fire nozzle 292 to extinguish the fire in sequence from fire with small degree to fire with large degree, and remove the obstacle along the indication route (step S336). If the control unit 200 determines that the fire cannot be extinguished, the control unit 200 itself may change the route. Next, in step S338, the refuge guide device 20 sets changed route as the latest guide information Sg, and step S332 is executed to continue to perform the route guide. Similarly, FIG. 4B may also describe a determining flowchart of shown in FIG. 3C. Assume that the refuge guide device 20 is located at the position Pa originally, after the fire happens, the refuge guide device 20 guides (according to guide information Sg) the user to move along the route Ra. If an infrared sensor 290 of the refuge guide device 20 senses the temperature Ti of environment surrounding a position Pf (which is ahead of the route to be passed) is too high, while moving along the indication route, and it is not possible to move forward, then the refuge guide device 20 itself determines to perform extinguishing, for moving along the original route Ra. Moreover, if the guide device 20 itself determines the fire is too large and is not extinguishable, then the route can be changed, and the new route Rb is followed to arrive another escape entrance Pc.

The aforementioned embodiments describe the refuge guide device 20 used for escape guide. According to another implementation of the present invention, when the refuge guide device 20 is used in hospital or rest home to perform fire evacuation to old or handicapped people, then the refuge guide device 20 may be a sick bed or wheel chair, and may further include equipment for user sitting or lying. Meanwhile, the memory element 202 of the refuge guide device 20 stores the map data and the guide information Sg of the hospital or rest home, and further stores specific user data, the specific user data, for example, age, health state and action capability of the user. In step S300 shown in FIG. 3A, the central server 10 first reads the specific user data of the refuge guide device 20, then transmits the guide information for specific user to the refuge guide device 20, similarly, the guide information includes the latest fire simulation and evacuation plan etc.

Figure 4C:
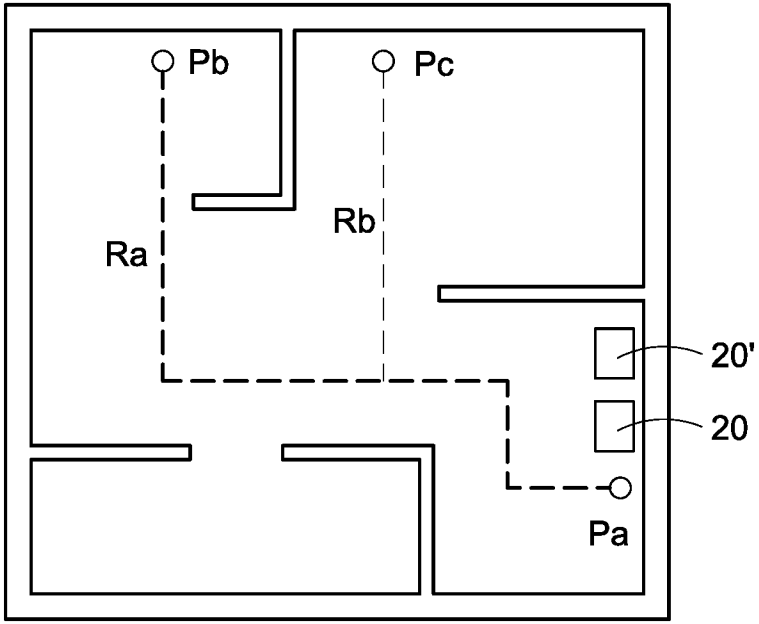
FIG. 4C shows a diagram of implementation of an operation method of the refuge guide system according to an embodiment of the present invention.

Refer to FIG. 4C, FIG. 4C describes implementation of different guide information set for different users of the refuge guide system of the present invention. For example, a user acting conveniently uses the refuge guide device 20, while another user acting with poor physical agility uses the refuge guide device 20' (that is, the refuge guide device 20' may be equipment like sick bed or wheel chair for moving patient conveniently), then if fire happens, the central server 10 may transmit different guide information Sg to the refuge guide device 20 and the refuge guide device 20' for performing different guide routes. As shown in FIG. 4C, the user of the refuge guide device 20 acting with better physical agility can apply a longer route (route Ra) to arrive the safe location Pb. The user of the refuge guide device 20' acting with poor physical agility can apply a shorter route (route Rb) to arrive the rescue location Pc to wait for the fireman. In the guide device 20', a control system located at the baseplate 22 can adjust a supporting angle, moving speed of the patient according to the surrounding environment, and the weight, action capability of the patient, through the gyroscope 262 and the gravity sensor 264.

In summary, the present invention has the following advantages:

1. The central server keeps updating the refuge route to guide safe route correctly.

2. The moving equipment used can lead the user to move forward.

3. The moving equipment also includes sensing device and fire extinguishing device, for sensing and extinguishing unexpected fire along the refuge route to ensure the effective evacuation of people.

Thus, particular embodiments have been described. Other embodiments are within the scope of the following claims. For example, the actions recited in the claims may be performed in a different order and still achieve desirable results.

What is claimed is:

1. A refuge guide system (100) comprising:

a central server (10) comprising:

a calculation unit (102);

a memory device (106) electrically connected to the calculation unit (102) and storing a map data and a user setting data; and a central communication unit (104) electrically connected to the memory device (106) and the calculation unit (102), the central communication unit (104) transmitting a guide information;

a refuge guide device (20) comprising:

a control unit (200) comprising a memory element (202);

a wired communication unit (250) electrically connected to the control unit (200);

a wireless communication unit (220) electrically connected to the control unit (200); and a transport unit (240) electrically connected to the control unit (200);

a plurality of fire monitoring devices (30) arranged for transmitting a fire information to the central server (10); and a wireless communication device (40) arranged for providing communication between the central server (10) and the refuge guide device (20), and providing a positioning data of the refuge guide device (20), wherein the refuge guide device (20) further comprises:

a baseplate (22) supporting the refuge guide device (20);

a low color-temperature light (280) electrically connected to the control unit (200), and arranged for auxiliary illumination;

an infrared sensor (290) electrically connected to the control unit (200), and arranged for sensing a locale environment temperature, and generating a locale fire information to the control unit (200); and a fire nozzle (292) electrically connected to the control unit (200), the fire nozzle (292) driven by the control unit (200) to extinguish fire.

2. The refuge guide system (100) of claim 1, wherein the calculation unit (102) is configured to calculate the guide information according to the positioning data of the refuge guide device (20), the map data, and the fire information.

3. The refuge guide system (100) of claim 1, wherein the central communication unit (104) is configured to perform wireless communication with the refuge guide device (20) through the wireless communication device (40).

4. The refuge guide system (100) of claim 1, wherein the central communication unit (104) is configured to perform wired communication with the refuge guide device (20) through a power line network.

5. The refuge guide system (100) of claim 1, further comprising an auxiliary positioning unit (260), the auxiliary positioning unit (260) comprising:

a gyroscope (262) providing an azimuth angle information of the refuge guide device (20); and a gravity sensor (264) sensing a speed and an acceleration of the refuge guide device (20);

wherein the auxiliary positioning unit (260) is configured to provide the azimuth angle information, the speed and the acceleration to the control unit (200).

6. The refuge guide system (100) of claim 1, wherein the central server (10) is configured to periodically transmit the guide information to the wireless communication unit (220) of the refuge guide device (20), and the wireless communication unit (220) is configured to transmit the guide information to the control unit (200), for storing the guide information in a memory element (202) of the control unit (200).

7. The refuge guide system (100) of claim 1, wherein the central server (10) is configured to transmit the guide information to the wireless communication unit (220) of the refuge guide device according to a certain condition, and the wireless communication unit (220) is configured to transmit the guide information to the control unit (200), for storing the guide information in a memory element (202) of the control unit (200).

8. The refuge guide system (100) of claim 1, wherein the wired communication unit (250) of the refuge guide device (20) is configured to receive the guide information, and is configured to transmit the guide information to the control unit (200), for storing the guide information in a memory element (202) of the control unit (200).

9. A refuge guide method arranged for a refuge guide device (20), the refuge guide method comprising the following steps:

transmitting a guide information to the refuge guide device (20) by a central server (10);

executing the guide information by the refuge guide device (20); and determining if a wireless communication device (40) configured to provide communication with the central server (10) by the refuge guide device (20), wherein if the refuge guide device (20) determines that a wireless communication device (40) is not configured to provide communication with the central server (10), a latest guide information received is used to guide, and the refuge guide method further comprises the following steps:

reading the latest guide information, and moving along an indication route of the guide information by the refuge guide device (20);

using a gyroscope (262) of an auxiliary positioning unit (260) to calculate an azimuth angle information of the refuge guide device (20), and using a gravity sensor (264) of the auxiliary positioning unit (260) to calculate a speed and an acceleration of the refuge guide device (20) by the refuge guide device (20);

determining if fire happens on the indication route and if the fire is able to be extinguished by a control unit (200) of the refuge guide device (20); and setting a changed route to be the latest guide information by the refuge guide device (20).

10. The refuge guide method of claim 9, wherein if the refuge guide device (20) determines that a wireless communication device (40) is configured to provide communication with the central server (10), the refuge guide device (20) is configured to continue to receive the guide information.

11. A refuge guide method arranged for a refuge guide device (20), the refuge guide method comprising the following steps:

transmitting a guide information to the refuge guide device (20) by a central server (10);

executing the guide information by the refuge guide device (20); and determining if a wireless communication device (40) configured to provide communication with the central server (10) by the refuge guide device (20), wherein the step of executing the guide information by the refuge guide device (20) further comprises:

reading the latest guide information, and moving along an indication route of the guide information by the refuge guide device (20);

determining if fire happens on the indication route and if the fire is able to be extinguished by a control unit (200) of the refuge guide device (20); and setting an updated guide information to be the latest guide information by the refuge guide device (20);

wherein if the control unit (200) determines that fire happens on the indication route, and the fire is able to be extinguished, then the control unit (200) controls a fire nozzle (292) of the refuge guide device (20) to extinguish the fire in sequence from small to large, if the control unit (200) determines that fire happens on the indication route, and the fire is not able to be extinguished, then the control unit (200) changes the indication route.

12. The refuge guide method of claim 11, wherein if the control unit (200) determines that fire happens on the indication route, and the fire is able to be extinguished, then the control unit (200) controls a fire nozzle (292) of the refuge guide device (20) to extinguish the fire in sequence from small to large.

13. The refuge guide method of claim 11, wherein if the control unit (200) determines that fire happens on the indication route, and the fire is not able to be extinguished, then the control unit (200) reports to the central server (10) for submitting request to change the indication route.

* * * * *